US011340558B2

(12) United States Patent
McDonnell

(10) Patent No.: US 11,340,558 B2
(45) Date of Patent: May 24, 2022

(54) MECHANISM FOR SELECTING AND ACTUATING FUNCTIONS OF A TIMEPIECE MOVEMENT

(71) Applicant: BREMONT WATCH COMPANY, Henley-on-Thames (GB)

(72) Inventor: Stephen McDonnell, Belfast (IE)

(73) Assignee: BREMONT WATCH COMPANY, Henley-on-Thames (GB)

( * ) Notice: Subject to any disclaimer, the term of this patent is extended or adjusted under 35 U.S.C. 154(b) by 621 days.

(21) Appl. No.: 16/316,357

(22) PCT Filed: Jun. 27, 2017

(86) PCT No.: PCT/IB2017/053817
§ 371 (c)(1),
(2) Date: Jan. 9, 2019

(87) PCT Pub. No.: WO2018/011654
PCT Pub. Date: Jan. 18, 2018

(65) Prior Publication Data

US 2019/0163139 A1 May 30, 2019

(30) Foreign Application Priority Data

Jul. 12, 2016 (CH) ..... 00888/16

(51) Int. Cl.
*G04B 27/02* (2006.01)
*G04B 27/04* (2006.01)

(52) U.S. Cl.
CPC ..... *G04B 27/026* (2013.01); *G04B 27/045* (2013.01)

(58) Field of Classification Search
CPC ..... G04B 27/02–065
See application file for complete search history.

(56) References Cited

U.S. PATENT DOCUMENTS 3,576,100 A * 4/1971 Vogt ..... G04B 27/04 368/32
3,673,790 A * 7/1972 Gasser ..... G04B 19/226 368/195
3,748,848 A * 7/1973 Laesser ..... G04B 27/026 368/31

(Continued)

FOREIGN PATENT DOCUMENTS

| | | |
|---|---|---|
| CH | 702803 | 9/2011 |
| CH | 707870 | 10/2014 |
| EP | 2012199 | 1/2009 |

*Primary Examiner* — Daniel P Wicklund

(57) ABSTRACT

A mechanism for selecting and actuating functions of a timepiece movement comprising a winding stem (1) terminated at one of the ends thereof by a crown, the winding stem (1) being displaceable in rotation and in axial translation, is arranged to occupy three distinct axial positions, namely a first winding position, a second position of selecting one among n functions in response to a rotation of the winding stem (1) about the axis thereof, and a third position of actuating a function kinematically linked to the winding crown. The mechanism further comprises a cam wheel (7) which, when the selection mechanism is in the second position thereof, is kinematically linked to the winding stem (1), the cam wheel (7) including a guide member (8) on which n rest positions are arranged, each corresponding to a function.

9 Claims, 9 Drawing Sheets

(56) References Cited

U.S. PATENT DOCUMENTS 3,762,156 A * 10/1973 Vuilleumier ..... G04B 27/005 368/192
3,775,966 A * 12/1973 Matsuura ..... G04B 27/04 368/32
3,798,893 A * 3/1974 Ippoushi ..... G04B 19/25 368/32
3,844,107 A * 10/1974 Guyot ..... G04B 27/005 368/22
4,112,673 A * 9/1978 Gilomen ..... G04B 27/02 368/196
4,127,985 A * 12/1978 Murrle ..... G04B 19/25 368/35
4,244,038 A * 1/1981 Ganter ..... G04B 19/25 368/35
4,423,964 A * 1/1984 Griessen ..... G04B 27/004 368/185
8,439,558 B2 * 5/2013 Pittet ..... G04B 27/04 368/192
2001/0046187 A1 * 11/2001 Graemiger ..... G04B 27/04 368/190
2006/0187761 A1 * 8/2006 Ito ..... G04B 27/02 368/139
2007/0230286 A1 * 10/2007 Scheufele ..... G04B 27/005 368/190
2009/0010109 A1 * 1/2009 Graemiger ..... G04B 27/065 368/190
2013/0201801 A1 * 8/2013 Calabrese ..... G04B 19/25313 368/34
2014/0056114 A1 * 2/2014 Monferrer ..... G04B 27/002 368/192
2015/0205265 A1 * 7/2015 Courvoisier ..... G04B 27/02 368/216
2016/0124388 A1 * 5/2016 Neboisa ..... G04B 27/04 368/190

* cited by examiner

MECHANISM FOR SELECTING AND ACTUATING FUNCTIONS OF A TIMEPIECE MOVEMENT

The present invention relates to the field of clockmaking and concerns more particularly a mechanism for selecting and actuating functions of a timepiece movement.

A timepiece is generally provided with several functions. For example, a function common to all timepieces is the time-setting allowing to adjust the display of the current time. Another function common to all mechanical watches is the reassembly of the energy source. If the timepiece allows displaying other time indications than the current time, it must also include correction functions of the different displays.

Another selection and correction mechanism is described in the patent EP2214066 and applies to a timepiece provided with a first and a second time indicating members. This correction mechanism comprises a winding stem, a corrector runner slidingly mounted between a first and a second correction positions in which the runner is in kinematic link respectively with the first and second time indication members. The mechanism comprises means for driving the corrector runner using the winding stem, and a mechanism for selecting the correction position comprising a selector arm cooperating with the corrector runner in order to drive it from the first correction position to the second correction position, an angular positioning member of the selector arm and a control member of said angular positioning member. However, this mechanism, due to the construction thereof, is limited to the correction of two functions only.

CH702548 describes a selection mechanism likely to be in a neutral position or to be displaced between two positions of correction by pressure on the winding crown, the correction being made only by rotation of the winding crown, without having to pull on the winding stem. For this purpose, the mechanism comprises a rocker having two arms on each of which a correction runner is mounted. The rocker pivots in order to select and actuate either one of the two functions to be corrected by means of one of the correction runners contacted with a member of the function to be corrected. However, if the neutral position, in which the rocker is in the neutral position, is not taken into account, this mechanism, due to the construction thereof, is limited to the correction of two functions only, the rocker being able to pivot only between two positions.

CH702803 which describes a correction mechanism is known, comprising correction levers arranged to increment counting members, a control lever pivotally mounted along a first axis of rotation and an arm pivotally mounted on said control lever along a second axis of rotation. The arm is angularly displaced relative to the control lever in response to a rotation of the crown in order to be placed facing either one of the correction levers. The control lever pivots to actuate the selected correction lever in response to an action on a pusher. The correction can therefore be made only by incrementing different counting devices, which makes impossible a bidirectional operation. Only a unidirectional correction of the counting members is possible.

The aim of the present invention is to overcome these drawbacks, by proposing a mechanism for selecting and actuating n functions of a timepiece movement allowing selecting and actuating more than two different functions of a timepiece movement.

According to the invention, a mechanism for selecting and actuating functions of a timepiece movement comprise a winding stem terminated at one of the ends thereof by a crown. The winding stem is displaceable in rotation and in axial translation and is arranged to occupy three distinct axial positions:

A first winding position,

A second position of selecting one among a number n of functions in response to a rotation of the winding stem about the axis thereof, and A third position of actuating a function kinematically linked to the winding crown.

The mechanism further comprises a cam wheel which, when the selection mechanism is in the second position thereof, is kinematically linked to the winding stem, said cam wheel including a guide member on which n rest positions are arranged, each corresponding to a function.

In an embodiment, the mechanism includes a coupling device including toothed wheels, the coupling device temporarily engaging with gear-trains of the timepiece movement in order to actuate one among n functions. According to this embodiment, the coupling device includes an elongate plate including holes capable of receiving pinions, pivoting about one of the axes of said holes in order to actuate one among n functions.

In a preferred embodiment, the guide member is a slot arranged in the cam wheel, the slot being for example in the shape of a curved line, in particular an open curved line with two ends. According to this preferred embodiment, a post is engaged in the slot arranged in the cam wheel, about which a pinion may rotate freely, the post being secured to the elongate plate.

In an embodiment, the mechanism includes, among the n functions, a time-setting function, a date correction function and a display function of at least one second time zone. Normally the number n of functions would be three or four but for practical reasons, the number n will not normally exceed five.

The features of the invention will appear more clearly upon reading the description of an embodiment given solely by way of example, and in no way imitative, with reference to the schematic figures, in which.

Figure 1:
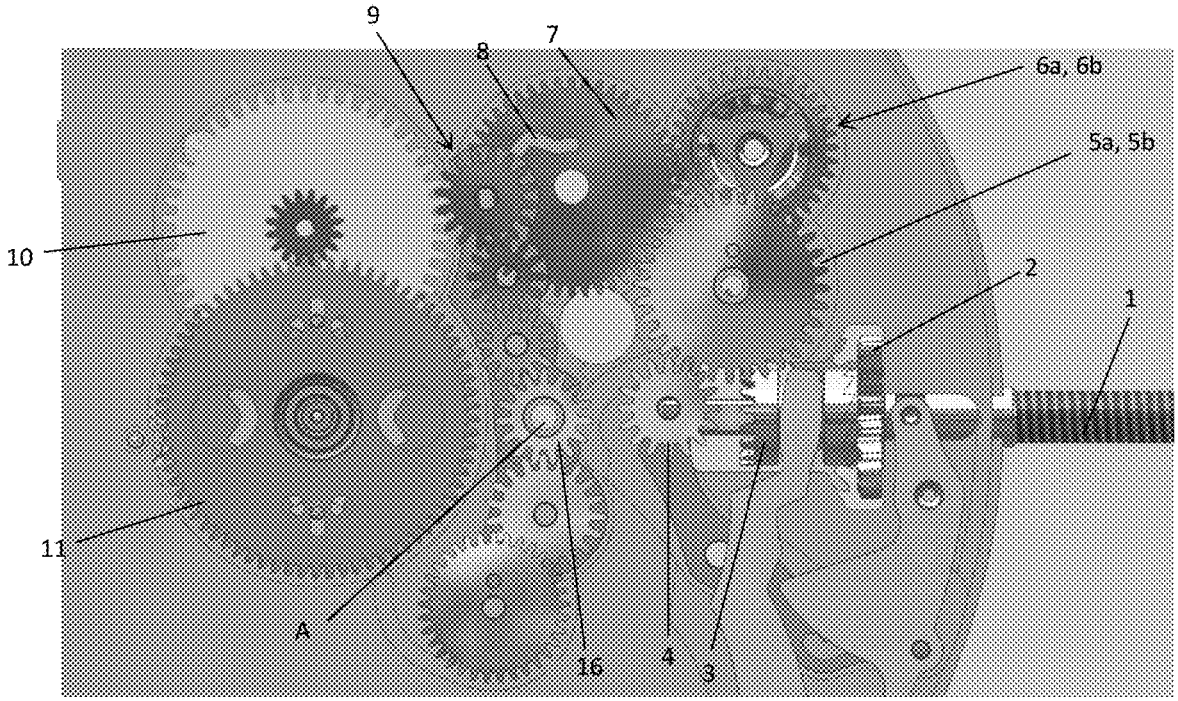
FIG. 1 represents a partial view of a watch movement including a mechanism for selecting and actuating a function of the movement actuating a winding function.
Figure 6A:
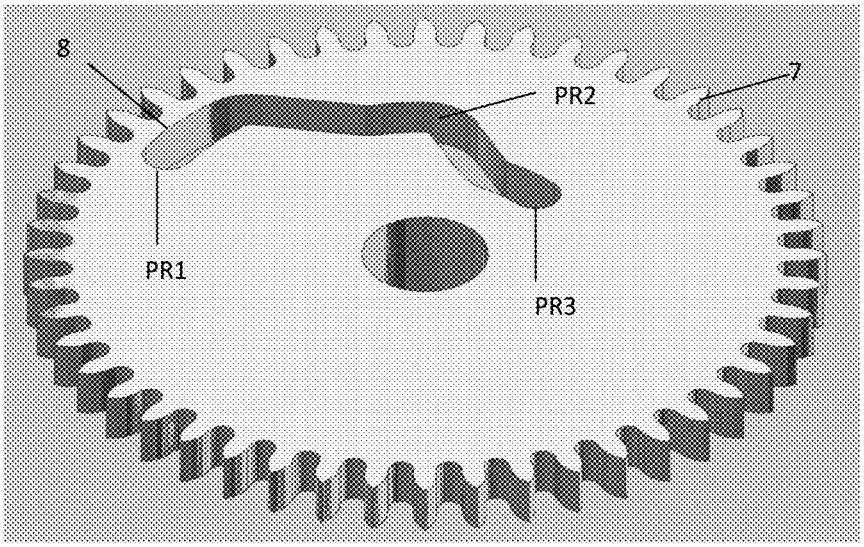
FIG. 6A represents a perspective view of a face of a cam wheel including a curved slot.

As illustrated in FIG. 1, a watch includes a mechanism for selecting and actuating four functions of a timepiece movement comprising a winding stem 1 terminated at the outer end thereof by a crown (not represented). The winding stem 1 is displaceable in rotation and in axial translation. The winding stem is arranged to occupy three distinct axial positions:

A first winding position (FIG. 1),

A second position of selecting one among three functions in response to a rotation of the winding stem 1 about the axis thereof (FIG. 2A, FIG. 4 and FIG. 11), and A third position of actuating a function (FIG. 3 and FIG. 13) kinematically linked to the winding crown, The mechanism further comprises a cam wheel 7 (see also FIGS. 6*a* and 6*b*) which, when the winding stem is in the second position thereof, is kinematically linked to the winding stem 1. The cam wheel 7 includes a guide member 8 on which are arranged three rest positions each corresponding to a function.

Thus, in this example, the three functions available when the selection mechanism is in the second position thereof added to the winding function of the watch when the winding stem is in the first position thereof thus allow offering four different functions.

In the example illustrated in FIG. 1, the winding stem 1 is in the first position thereof. In this configuration, by rotating the winding stem 1, a flowing pinion 3, secured to the winding stem, rotates by driving the winding pinion 2.

Figure 2A:
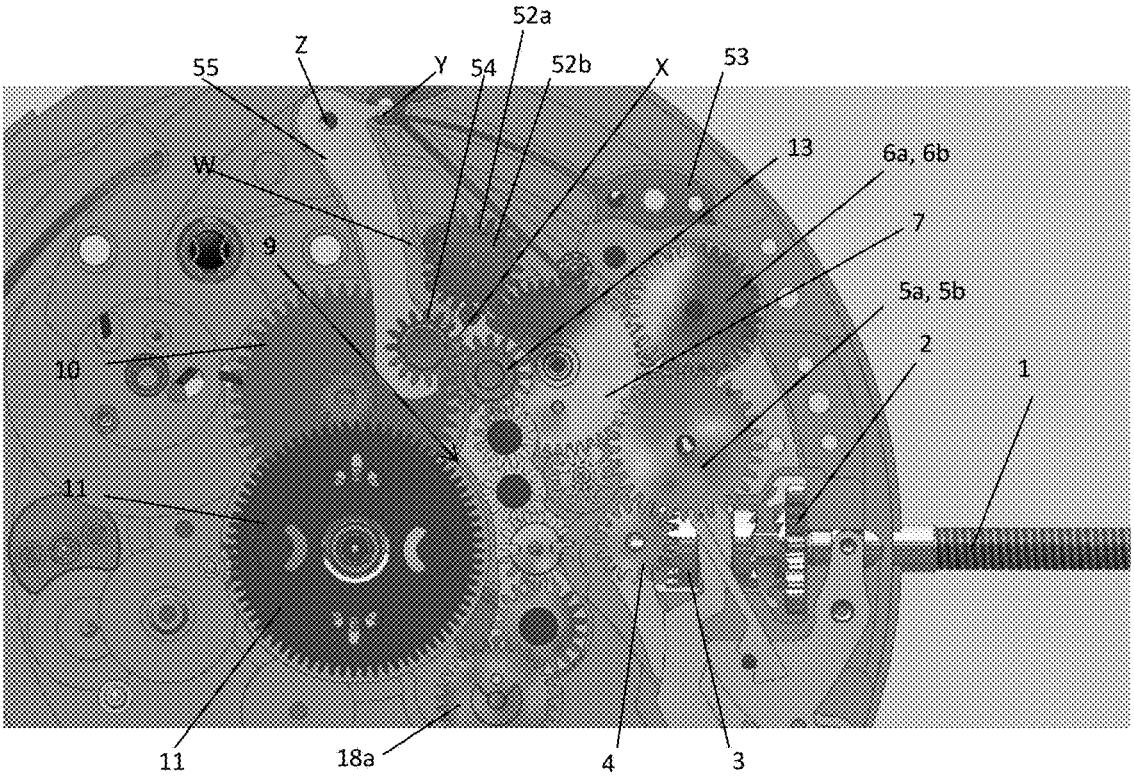
FIG. 2A represents a partial view of a watch movement including a mechanism according to the present invention configured for a time-setting function, a winding stem being in a second position.

In the example illustrated in FIG. 2A, the winding stem 1 is in the second position thereof. It is in this second position that the selection of the function is performed. A flowing pinion 3 meshes with a setting wheel 4. The setting wheel 4 drives the cam wheel 7 by means of double pinions 5*a*, 5*b*, 6*a*, 6*b*. In this configuration, the selected function corresponds to the time-setting once the winding stem is in the third position thereof. In a second position, the coupling device 9 is arranged so that a pinion 13 of the coupling device 9 meshes with the minute wheel 10.

Figure 2B:
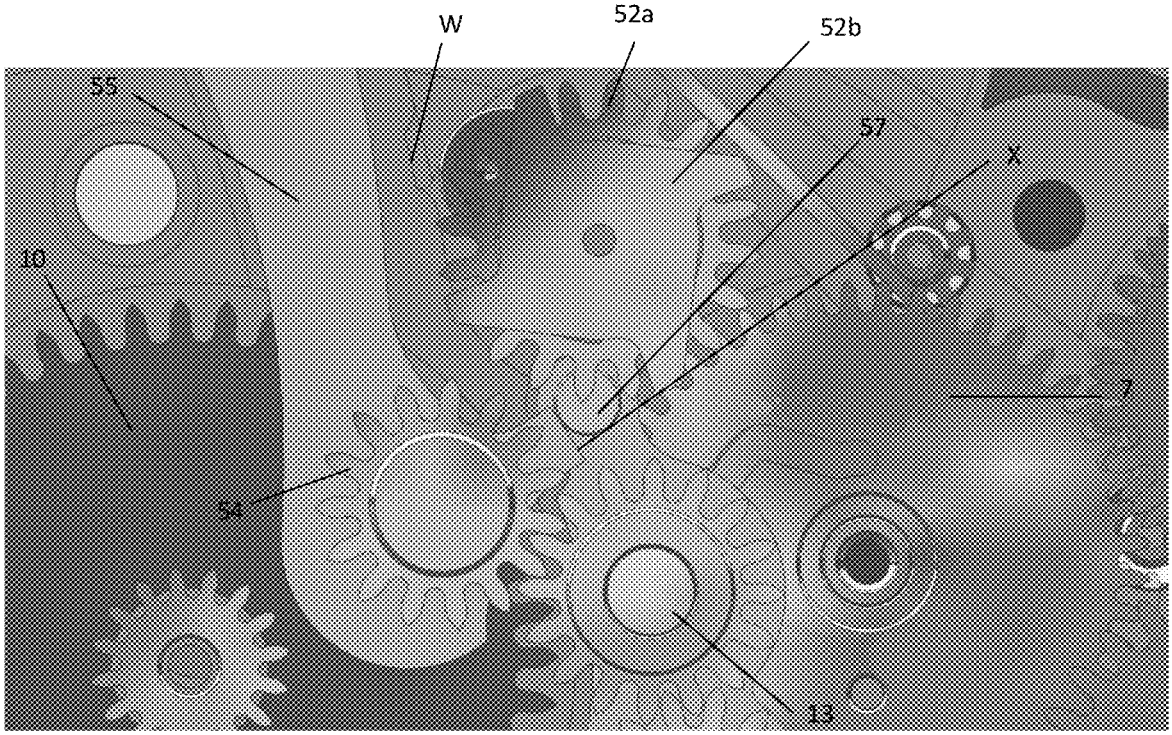
FIG. 2B represents an enlarged view of a rocker element of FIG. 2A.
Figure 10:
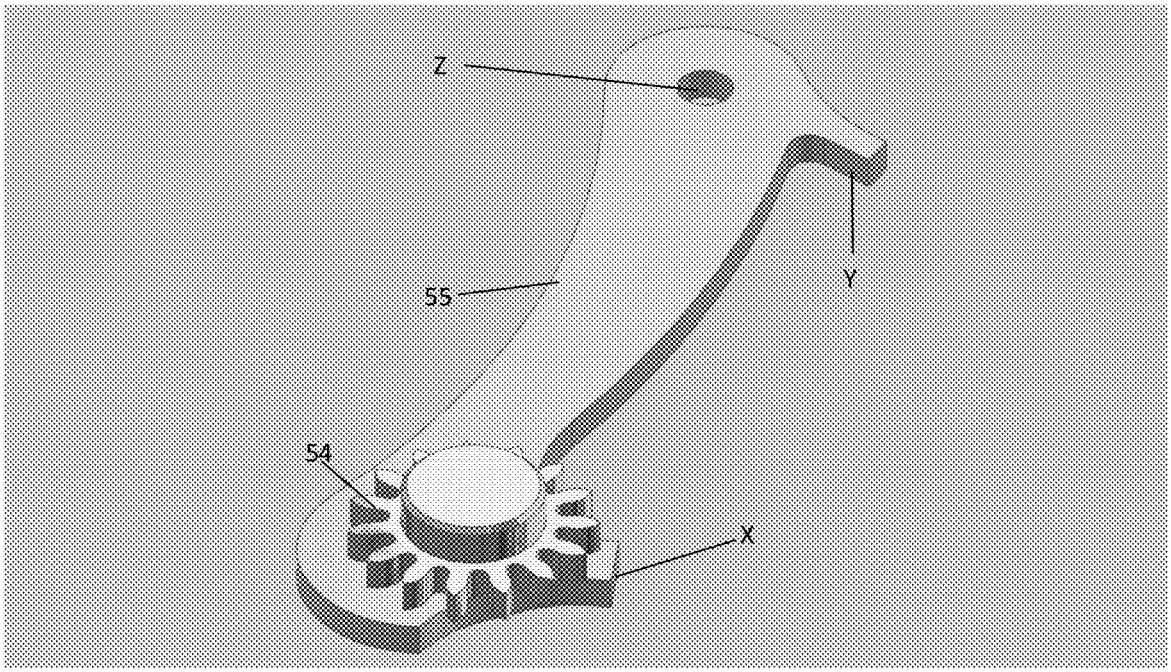
FIG. 10 represents a perspective view of a slider including a sliding pinion.

As illustrated in FIGS. 2A and 2B, a pin 57 of the coupling has pushed on the pulse plane X of a slider 55, said slider 55 then rotating clockwise about the axis Z thereof (FIG. 2A and FIG. 10). A surface Y (FIG. 2A and FIG. 10) of the slider 55 has tensioned a return spring 53 (FIG. 2A). The slider is no longer in contact with the stop thereof W. The pinion 13 of the coupling always meshes with the pinion 54 of the slider. There is no contact between the pinion 54 of the slider and the date correction runner 52*a*, 52*b*. There is no contact between the pinion 18*a* of the coupling and the GMT wheel 11.

As illustrated in FIG. 10, the slider 55, includes a pinion 54, the pivot of the pinion 54 freely rotating in a hole of the slider 55. The slider 55 includes a pivoting hole Z of the slider, a contact surface Y on which acts a return spring rotating the slider 55 counterclockwise and a pulse plane X to rotate the slider clockwise.

Figure 3:
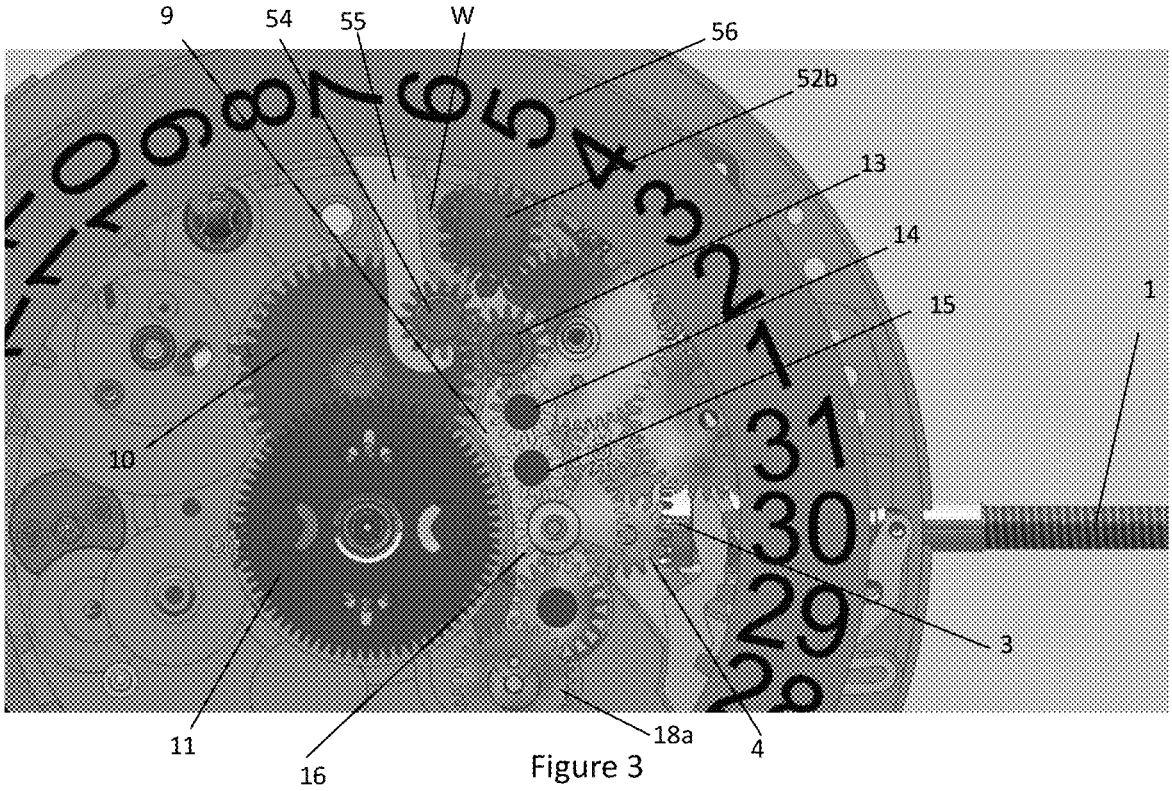
FIG. 3 represents a partial view of a watch movement including a mechanism according to the present invention configured to actuate a time-setting function, the winding stem being in a third position.

As illustrated in FIG. 3, the winding stem 1 is in the third position thereof. Thus, by rotating the winding stem 1, the time is adjusted thanks to the pinion 13 of the coupling device 9 which meshes with the minute wheel 10, by means of the setting wheel 4 and the toothed wheels 14, 15, 16.

Figure 4:
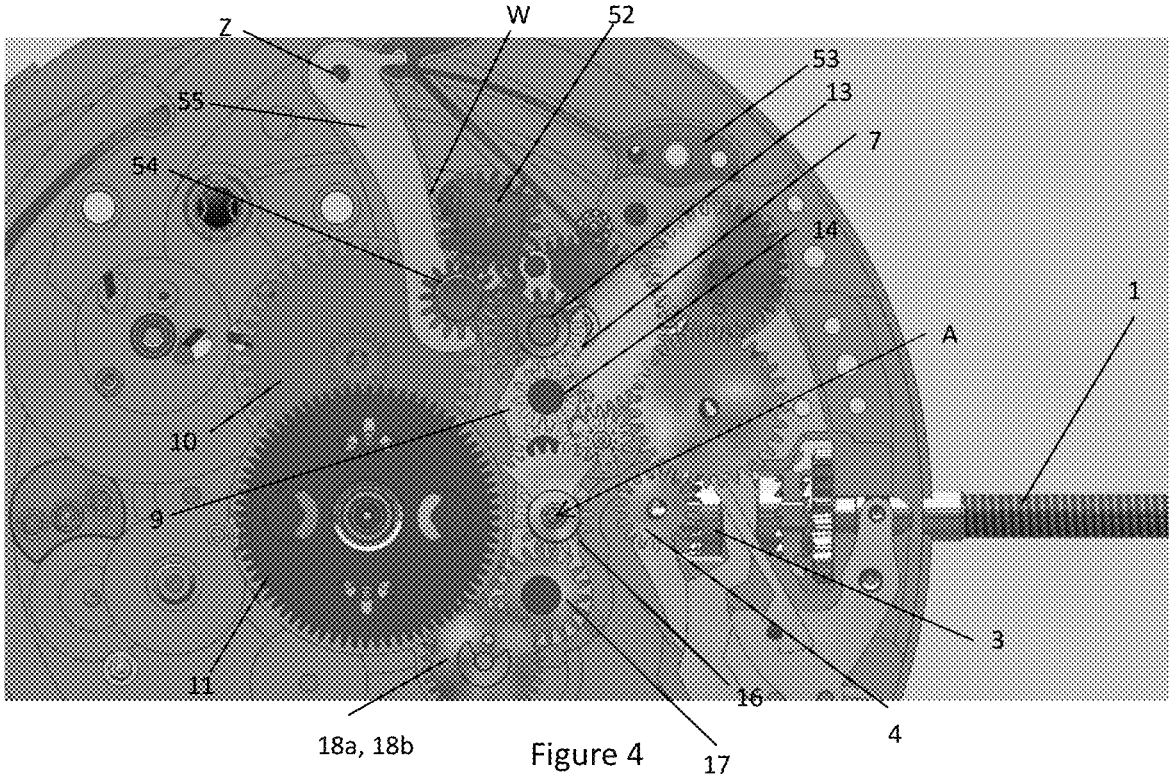
FIG. 4 represents a partial view of a watch movement including a mechanism according to the present invention configured for a GMT correction function, said winding stem being in a second position.

In the example illustrated in FIG. 4, the winding stem 1 is in the second position. The rotation of the winding stem 1 has allowed to rotate the cam wheel 7. Thus, the coupling device 9 has performed a rotation about the pivot A thereof. The pinion 13 no longer meshes with the minute wheel 10, but it is a double pinion 18*a*, 18*b* which meshes with the GMT wheel 11. Thus, in this configuration, once the winding stem is in the third position thereof, an adjustment of the GMT hand will be possible. The slider 55 is in the rest position thereof. It remains against a stop W which is part of the platen. The return spring 53 maintains the slider 55 in contact with the stop W. There is no contact between the pinion 13 of the coupling and the pinion 54 of the slider 55.

According to this example, in order to actuate the correction of a GMT hand, the winding stem 1 must be in the third position thereof. The flowing pinion 3 then meshes with the setting wheel 4, but now the setting wheel 4 meshes with the pinion 16 of the coupling. By rotating the winding stem 1, all pinions 16, 17, 18*a*, 18*b* of the coupling device are rotated. Thus, a setting of a GMT hand may be performed in order to display a second time zone.

Figure 5:
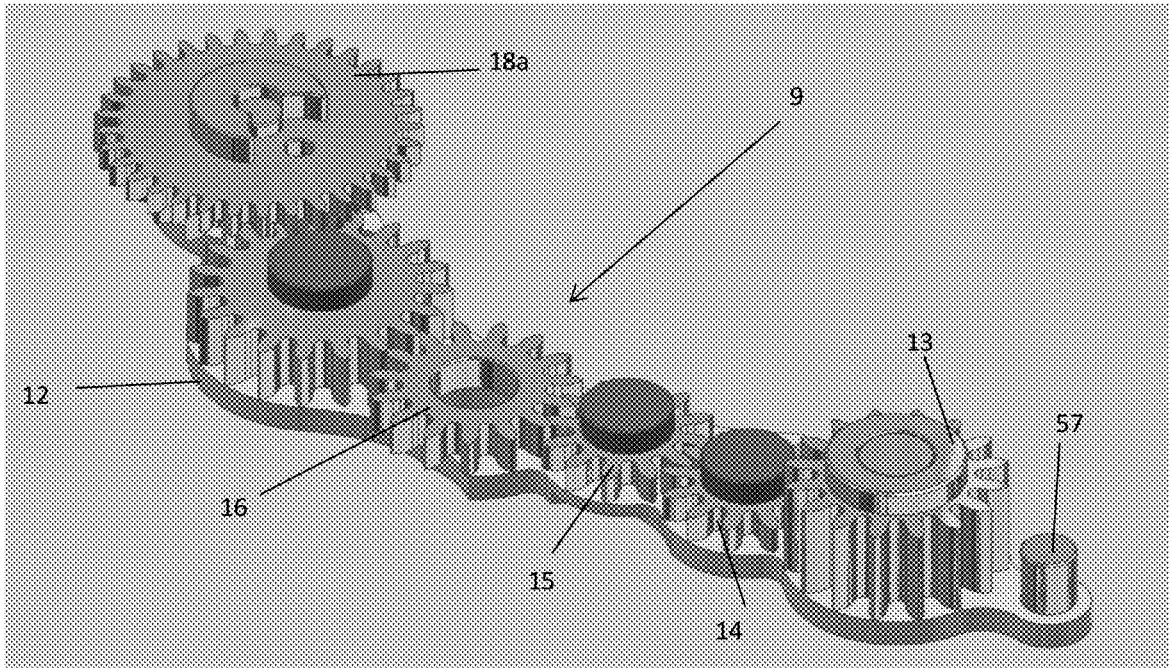
FIG. 5 represents an elongate plate forming part of a coupling device of the mechanism, said plate carrying pinions.

The coupling device 9 includes toothed wheels 13, 14, 15, 16, 17, 18*a*, 18*b* (FIG. 5). The coupling device 9 temporarily engages gear-trains of the timepiece movement to actuate one among three functions. The coupling device 9 includes an elongate plate 12 including holes capable of receiving pinions, in this case six holes as well as a pin 57 arranged at an end of the elongate plate 12, said elongate plate 12 pivoting about a central axis A (FIG. 4) in order to actuate one among the three functions.

The coupling device 9 is therefore provided with six pinions 13, 14, 15, 16, 17, 18*a*, 18*b*, which pivot freely on the six holes of the elongate plate 12. Posts (see FIG. 5) are driven in the holes, allowing the six pinions 13, 14, 15, 16, 17, 18*a*, 18*b* to pivot on these posts.

Figure 6B:
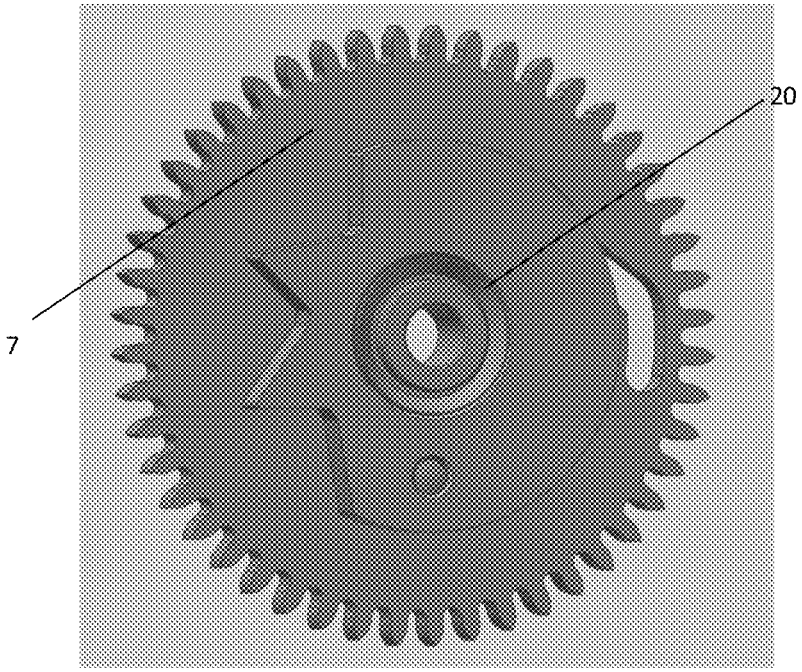
FIG. 6B represents a perspective view of the other face of the cam wheel carrying an indexing wheel.
Figure 7:
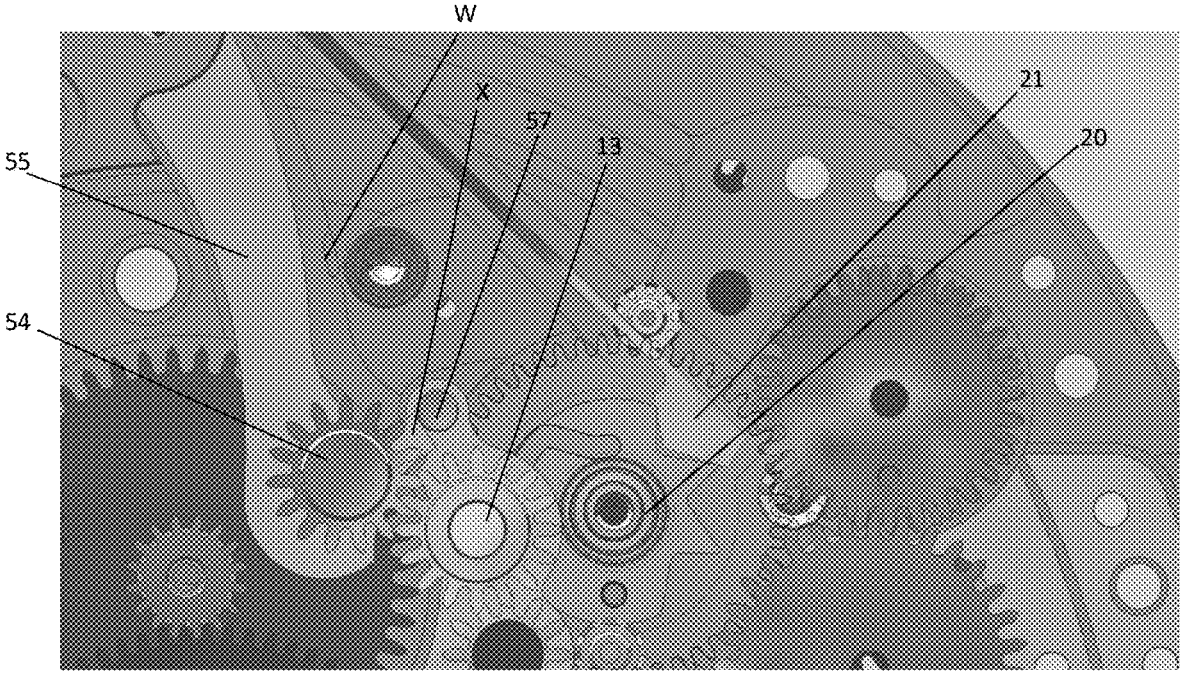
FIG. 7 represents a partial view of a watch movement including a mechanism according to the present invention, said mechanism including a jumper for indexing the positions of a cam wheel, illustrated in semi-transparency, in order to select motion functions.

The cam wheel 7 includes a slot 8 (FIG. 6A) so that a post, not illustrated, of the pinion 13 protrudes below the elongate plate 12 of the coupling device in order to engage in the slot 8 of the cam wheel 7. The cam wheel 7 includes an open slot 8 with two ends, each defining a rest position PR1, PR3. The slot 8 has a bent shape defining a third rest position PR2. Each of the rest positions PR1, PR2, PR3 corresponds to a function. FIG. 6B illustrates the rear face of the cam wheel 7 allowing to visualize a wheel 20, secured to the cam wheel 7, arranged to cooperate with a jumper 21 (FIG. 7) so as to index the positions of the wheel cam 7.

Figure 11:
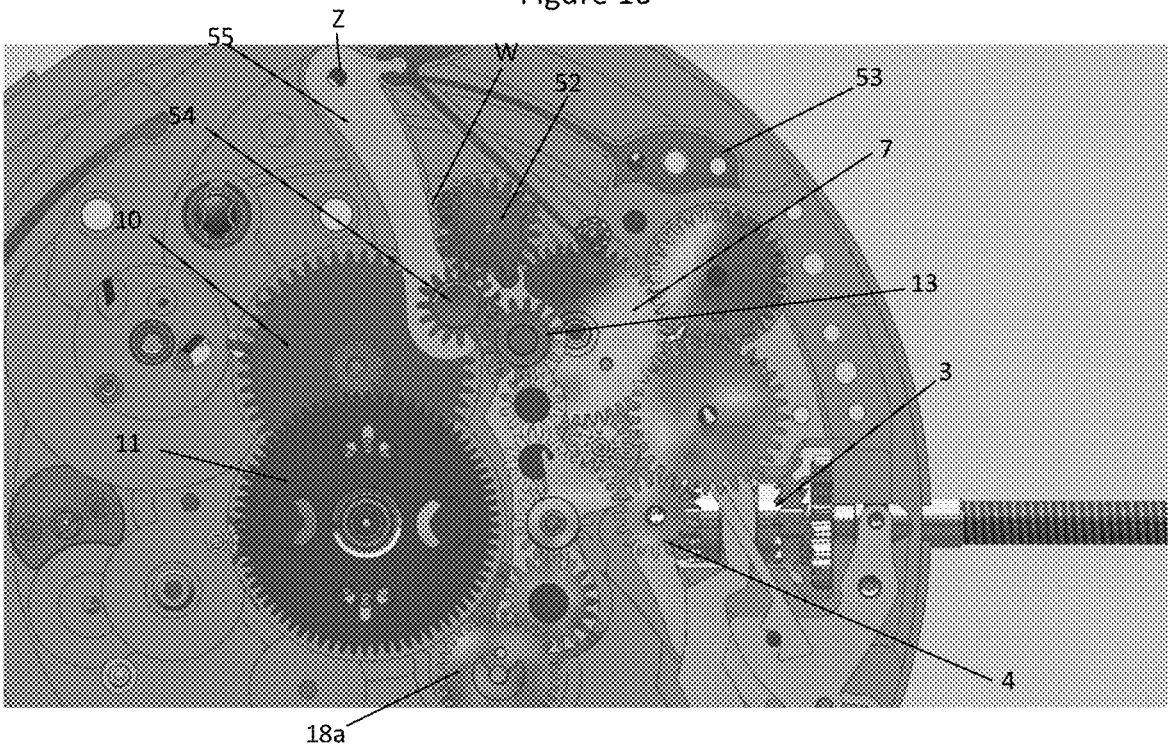
FIG. 11 represents a partial view of a watch movement including a mechanism according to the present invention configured for a date function, said winding stem being in a second position.
Figure 12:
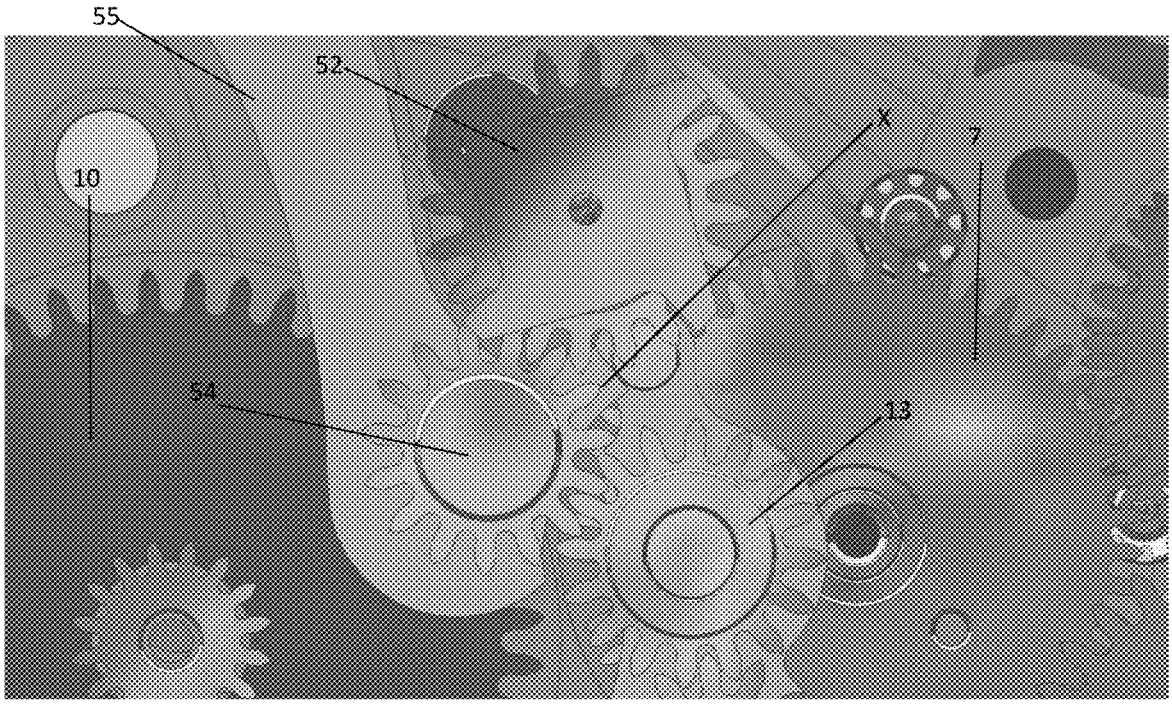
FIG. 12 represents an enlarged view of a rocker element of FIG. 11.

On the same principle as previously, and as illustrated in FIG. 11, the coupling device allows selecting a function for adjusting the date. In this example, a pinion 13 of the coupling meshes with a pinion 54 of the slider 55. There is no contact between the pinion 18*a* of the coupling and the GMT wheel 11. There is no contact between the pinion 13 of the coupling and the minute wheel 10. The slider 55 is always in the rest position thereof, and in contact with the stop W thereof. In this position, the pinion 54 of the slider meshes with the runner of the date correction 52. The pin 57 of the coupling is in contact with the pulse plane X of the slider 55 (see FIG. 12).

Figure 9A:
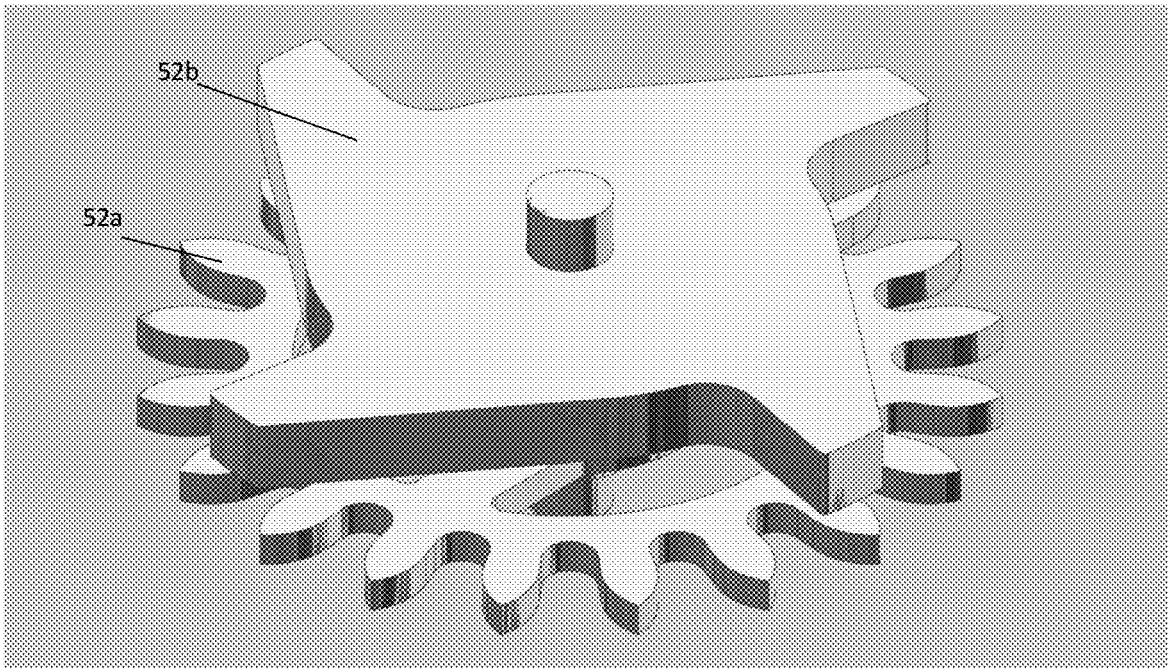
FIGS. 9A and 9B represent a perspective view and a side view of a date correction runner.
Figure 9B:
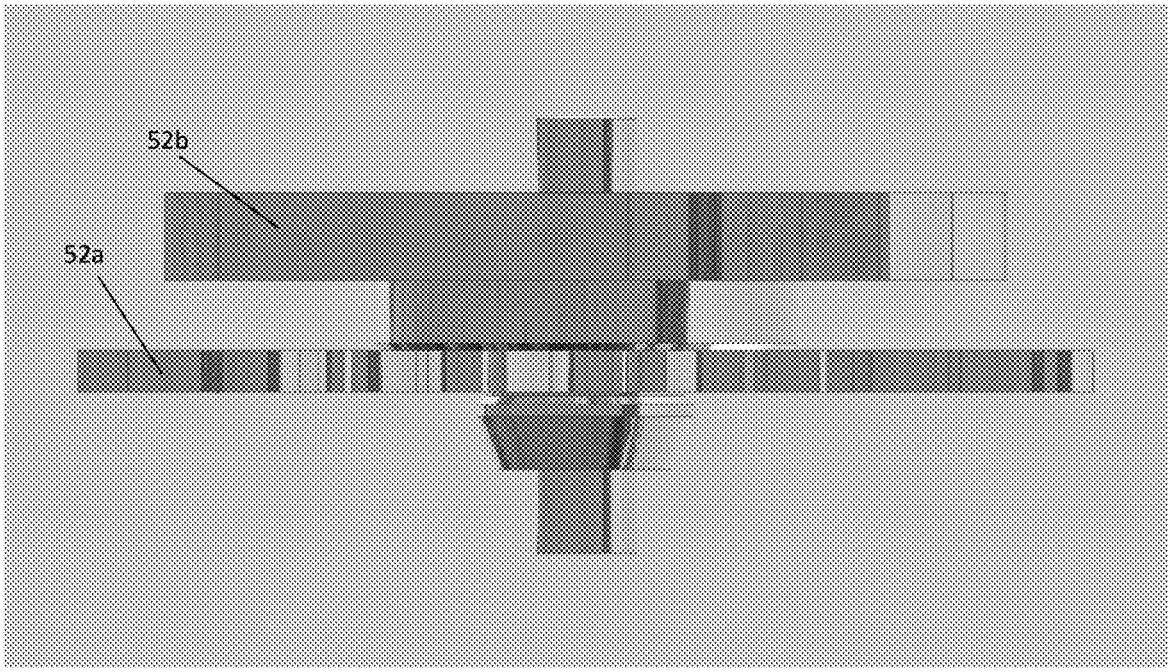
Figure 13:
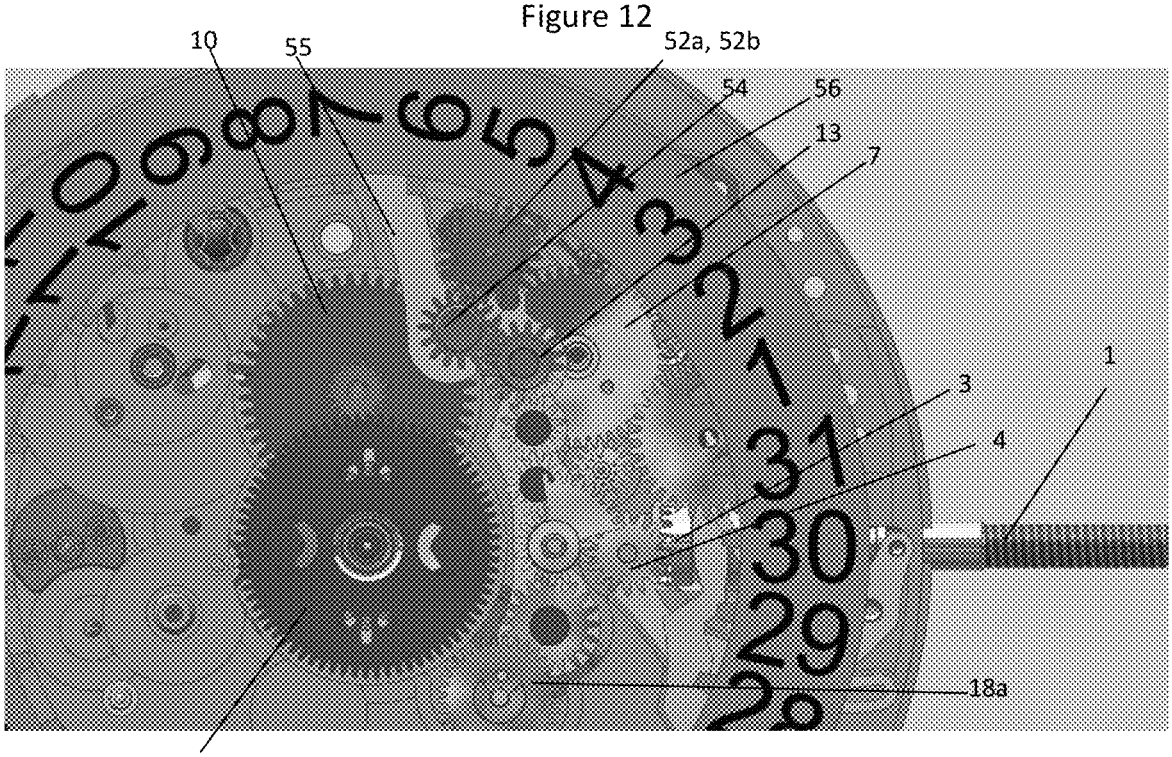
FIG. 13 represents a partial view of a watch movement including a mechanism according to the present invention configured to actuate a date function, said winding stem being in a third position.

As illustrated in FIG. 13, the winding stem 1 is in the third position thereof, in order to actuate the date correction function. The flowing pinion 3 drives the setting wheel 4. The setting wheel 4 drives the pinion 16 and, consequently, all runners of the coupling 9. The pinion 13 of the coupling drives the pinion 54 of the slider. The pinion 54 of the slider drives the date correction runner 52*a*, 52*b* (see FIG. 9A and FIG. 9B) which drives the date disc 56.

Figure 8:
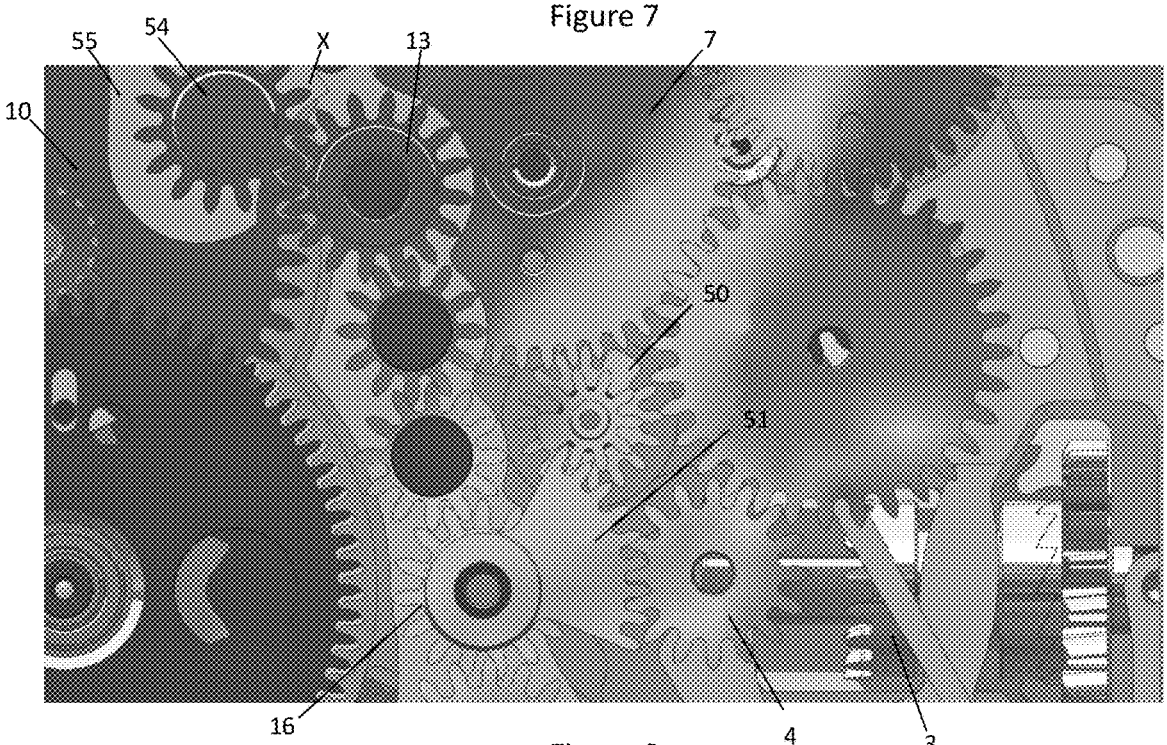
FIG. 8 represents a partial view of a watch movement including a mechanism according to the present invention, the mechanism including a toothed sector arranged to carry a hand.
Figure 14:
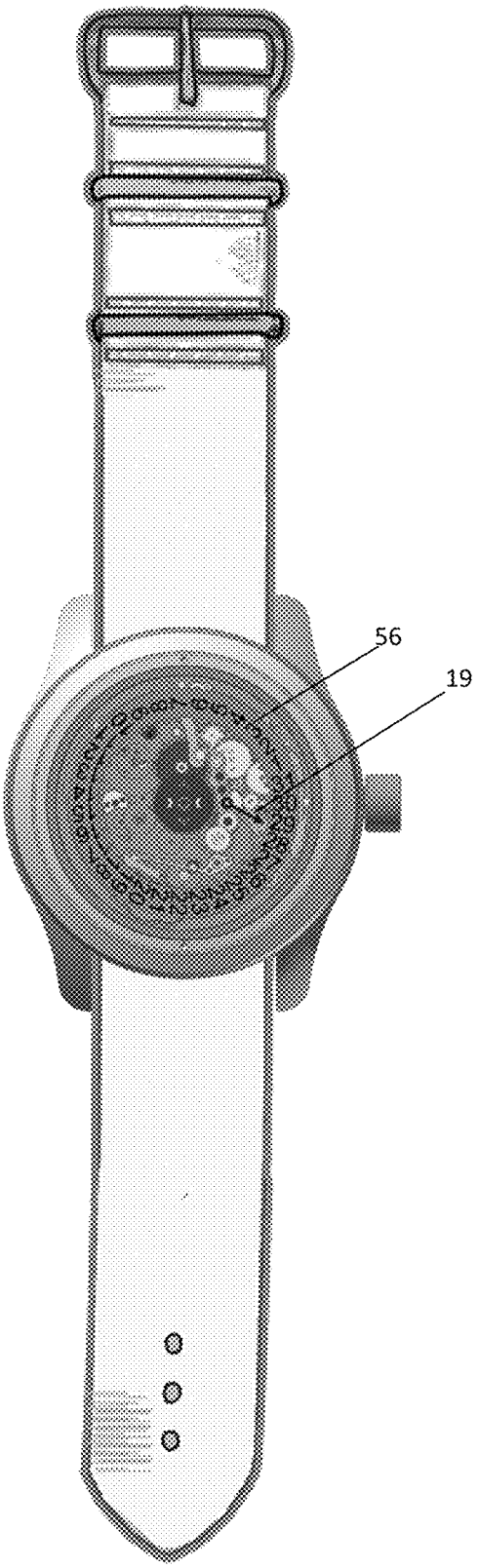
FIG. 14 represents a wristwatch including a mechanism according to the present invention.

Marks on the winding stem 1, on the crown and/or on a casing allow to easily visualize the relative position of the crown and of the winding stem 1 relative to the casing. These marks may be made on one or both pieces, by marking or by machining a groove or a slot. It is also possible to determine the selected function by displaying the selected function on a watch dial, as illustrated in FIG. 14 thanks to a hand 19 visible from a watch crystal. The cam wheel 7 drives a double pinion 50, which drives a sector 51 (see FIG. 8). The pivot axis of the sector is coaxial with that of the coupling 9. The sector 51 carries the selected function indicating hand.

Moreover, the tactile perception during the rotation of the winding stem 1 allows detecting a change of function without having to look at the timepiece, in particular in the case where no selected function indicating hand was provided.

The preceding examples allowed to illustrate how it was possible to select four different functions thanks to the selection mechanism of the present invention.

It may be understood how it would be possible, with the winding stem in the second position thereof, to consider the selection of one function among four. The same principle of the slider is used, and a second slider is added, which would cooperate with the pinion 18*a* of the coupling. In this manner, a second intermediate position is created, which allows for example setting an alarm clock. In this case, the slot in the cam wheel 7 would have four rest positions and consequently the coupling 9 would have four indexed positions.

FIG. 14 illustrates a wristwatch including a mechanism according to the present invention. The wristwatch is illustrated without a dial so as to be able to visualize the mechanism and in particular the date disc 56. In this example, the date may be visualized through a window arranged in a dial. A selected function indicating hand 19 is also illustrated, the hand, in normal operation, having to be arranged above a dial so as to be visible, the information of the selected function being inscribed on said dial.

The invention claimed is:

1. A mechanism for selecting and actuating functions of a timepiece movement comprising a winding stem (1) terminated at one of the ends thereof by a crown, said winding stem (1) being displaceable in rotation and in axial translation, said winding stem (1) being arranged to occupy three distinct axial positions:

a first winding position, a second position of selecting one among an n number of functions in response to a rotation of the winding stem (1) about the axis thereof, and a third position of actuating a function kinematically linked to the winding stem, said mechanism further comprising a cam wheel (7) which, when the mechanism for selecting and actuating functions is in the second position thereof, is kinematically linked to the winding stem (1), characterized in that said cam wheel (7) includes a guide member (8) in the form of a slot formed by a bent curved line on which are arranged n rest positions each corresponding to one of the n number of functions.

2. The mechanism according to claim 1, including a coupling device (9) including toothed wheels (13, 14, 15, 16, 17, 18*a*, 18*b*), said coupling device temporarily engaging said toothed wheels (13, 14, 15, 16, 17, 18*a*, 18*b*) with gear-trains of the timepiece movement in order to actuate one among the n functions when the winding stem (1) is in the second position.

3. The mechanism according to claim 2, wherein the coupling device (9) includes an elongate plate (12), said elongate plate (12) including holes capable of receiving pinions, pivoting about one of the axes of said holes in order to actuate one among n functions and said elongate plate (12) of the coupling device (9) pivoting about the axis (A) parallel of said axes of said holes.

4. The mechanism according to claim 3, wherein a post is engaged in the slot (8) arranged in the cam wheel (7), the post being secured to said elongate plate (12).

5. The mechanism according to claim 2, wherein the toothed wheels of the coupling device (9) includes six pinions (13, 14, 15, 16, 17, 18*a*, 18*b*), including at least one double pinion (18*a*, 18*b*).

6. The mechanism according to claim 1, including among the n selectable functions, a time-setting function and a date correction function.

7. The mechanism according to claim 1, wherein a flowing pinion (3), arranged at the other end of the winding stem (1), meshes with a setting wheel (4) which kinematically drives the cam wheel (7).

8. A timepiece including the mechanism for selecting and actuating functions according to claim 1.

9. A timepiece according to claim 8, including the crown fastened to the end of the winding stem (1) and a casing, the casing and/or the crown of the timepiece including means allowing visualizing the selected function.

* * * * *